US009561811B2

(12) United States Patent
Traylor et al.

(10) Patent No.: US 9,561,811 B2
(45) Date of Patent: Feb. 7, 2017

(54) RAILROAD CONTROL SYSTEM HAVING ONBOARD MANAGEMENT

(71) Applicant: Progress Rail Locomotive Inc., LaGrange, IL (US)

(72) Inventors: Isaac Traylor, Brookfield, IL (US); James David Seaton, Westmont, IL (US); David Matthew Roenspies, Elburn, IL (US); Alexander Shubs, Jr., Chicago, IL (US)

(73) Assignee: PROGRESS RAIL LOCOMOTIVE INC., Lagrange, IL (US)

( * ) Notice: Subject to any disclaimer, the term of this patent is extended or adjusted under 35 U.S.C. 154(b) by 0 days.

(21) Appl. No.: 14/577,707

(22) Filed: Dec. 19, 2014

(65) Prior Publication Data

US 2016/0176425 A1 Jun. 23, 2016

(51) Int. Cl.

| | |
|---|---|
| ***B61L 27/04*** | (2006.01) |
| ***B61L 23/00*** | (2006.01) |
| ***B61L 3/00*** | (2006.01) |
| ***B61L 15/00*** | (2006.01) |
| ***B61L 27/00*** | (2006.01) |

(52) U.S. Cl.

CPC ..... *B61L 3/006* (2013.01); *B61L 15/0027* (2013.01); *B61L 15/0063* (2013.01); *B61L 15/0072* (2013.01); *B61L 15/0081* (2013.01); *B61L 27/0094* (2013.01)

(58) Field of Classification Search

CPC ..... B61L 27/04; B61L 27/0027; B61L 27/00; B61L 23/00; B61L 23/08; B61L 13/00; B61L 13/16; B61L 3/00; B61L 3/16; B61L 3/006; B61L 27/0005; B61L 27/0038; B61L 27/0044; B61L 23/14; B61C 17/12

USPC ..... 701/19, 20

See application file for complete search history.

(56) References Cited

U.S. PATENT DOCUMENTS

| | | | |
|---|---|---|---|
| 6,587,764 | B2 | 7/2003 | Nickles et al. |
| 7,618,011 | B2 | 11/2009 | Oleski et al. |
| 7,869,908 | B2 | 1/2011 | Walker |
| 8,645,047 | B2 | 2/2014 | Daum et al. |
| 8,712,611 | B2 | 4/2014 | Denis et al. |

(Continued)

FOREIGN PATENT DOCUMENTS

| | | |
|---|---|---|
| CN | 101587634 B | 1/2011 |

*Primary Examiner* — Thomas G Black
*Assistant Examiner* — Sara Lewandroski
(74) *Attorney, Agent, or Firm* — Finnegan, Henderson, Farabow, Garrett & Dunner LLP

(57) ABSTRACT

A railroad control system is disclosed for a network of trains. The system may include a centralized control system configured to transmit trip parameters for each train in the network. The system may include an energy manager in communication with the centralized control system and located onboard each train. The energy manager may be configured to determine an energy profile for a consist of the train based on the trip parameters. The system may further include a consist manager located onboard the consist and configured to determine a distribution of the energy profile for each locomotive of the consist. The system may also include one or more locomotive managers, each associated with a locomotive of the consist, and configured to determine a power configuration of the one locomotive based on the distribution of the energy profile and known parameters of the locomotive.

18 Claims, 2 Drawing Sheets

(56) References Cited

U.S. PATENT DOCUMENTS

| | | | | |
|---|---|---|---|---|
| 2004/0010432 | A1* | 1/2004 | Matheson | B61L 27/0016 705/7.22 |
| 2004/0172174 | A1* | 9/2004 | Julich | B61L 27/0016 701/19 |
| 2011/0257869 | A1* | 10/2011 | Kumar | B61L 3/006 701/103 |
| 2014/0012454 | A1* | 1/2014 | Fournier | G06Q 10/04 701/23 |
| 2014/0094998 | A1* | 4/2014 | Cooper | B61L 3/006 701/2 |
| 2014/0180510 | A1* | 6/2014 | Fournier | B61L 27/0027 701/20 |
| 2014/0207316 | A1* | 7/2014 | Kolambekar | B61C 17/12 701/19 |
| 2014/0316618 | A1* | 10/2014 | Matthews, Jr. | B60L 15/38 701/19 |
| 2015/0088344 | A1* | 3/2015 | Shakal | B61C 17/12 701/20 |
| 2015/0168158 | A1* | 6/2015 | Mathews, Jr. | G01C 21/26 701/400 |
| 2015/0232097 | A1* | 8/2015 | Luther | B61L 3/006 701/123 |

* cited by examiner

RAILROAD CONTROL SYSTEM HAVING ONBOARD MANAGEMENT

TECHNICAL FIELD

The present disclosure relates generally to a railroad control system and, more particularly, to a railroad control system having onboard management.

BACKGROUND

A railroad system is composed of a network of trains operated by a centralized traffic controller. The network of trains transmits operating conditions to the controller, while the controller operates switches and/or provides instruction to ensure the trains reach their destinations. Each train is constituted of a plurality of locomotives, with each locomotive being propelled by a plurality of engines and traction motors.

The complexity of the network requires multiple levels of control working concertedly to ensure efficiency. The centralized traffic controller is typically concerned with providing the train with broad routing goals to reduce traffic congestion of the railroad network. The operator of the individual train is then responsible for distributing sufficient power to each of the locomotives in the consist, then to each of the engines and traction motors of the locomotives. Inefficient operation of the individual components of a train can result in loss of productivity, excessive air and noise pollution, and poor fuel consumption.

One attempt to improve operation of a railroad system is disclosed in U.S. Pat. No. 8,645,047 by Daum et al. that published on Feb. 4, 2014 ("the '047 patent"). In particular, the '047 patent discloses a system for automating train performance in the presence of changing optimization parameters. The system simplifies user operation of the train by identifying a plurality of discrete potential dynamic events, and for each potential dynamic event, computing optimization profiles that describe power settings. The computed optimization profiles are based on a selected speed, fuel efficiency, vehicle emissions, and vibrations. From a remote location, the user then selects the desired optimization profile, and the train is operated based on the power settings.

Although the system of the '047 patent may help to improve the overall operation of a train, it does not address how the individual components are controlled to perform the desired profile. It may be helpful to utilize the architecture of the train network to ensure each of the components of a train is operating in the most efficient manner.

The disclosed railroad control system is directed to overcoming one or more of the problems set forth above and/or other problems of the prior art.

SUMMARY

In one aspect, the present disclosure is directed to a railroad control system for a network of trains. The system may include a centralized control system configured to transmit trip parameters for each train in the network. The system may include an energy manager in communication with the centralized control system and located onboard each train. The energy manager may be configured to determine an energy profile for a consist of the train based on the trip parameters. The system may further include a consist manager located onboard the consist and configured to determine a distribution of the energy profile for each locomotive of the consist. The system may also include one or more locomotive managers, each associated with a locomotive of the consist, and configured to determine a power configuration of the locomotive based on the distribution of the energy profile and known parameters of the locomotive.

In another aspect, the present disclosure is directed to a method of controlling a railroad network including a plurality of trains. The method may include transmitting trip parameters associated with a desired trip from a centralized control system to each train. The method may also include determining an energy profile for at least one consist of each train based on the trip parameters, and distributing the energy profile to each locomotive of the at least one consist. The method may further include determining a power configuration of engines and traction motors onboard each locomotive based on the distribution of the power profile.

In yet another aspect, the present disclosure is directed to a railroad network. The railroad network may include a network of trains, each train including a consist having one or more locomotives. The railroad network may include a centralized control system including an operator interface configured to receive train-specific goals and a central controller configured to transmit trip parameters for each train. The railroad network may include an energy manager located onboard each consist and configured to determine and update an energy profile for the consist based on the trip parameters, train-specific goals, and current train parameters, wherein the operator interface is configured to communicate with the energy manager via a first network, and the central controller is configured to communicate with the energy manager via a second network. The railroad network may include a consist manager located onboard each consist and configured to determine a distribution of the energy profile for each locomotive of the consist, and to distribute the energy profile among each locomotive of the consist. The railroad network may include a plurality of locomotive managers, each locomotive manager associated with a locomotive of the consist, and configured to receive the distributed energy profile for only the locomotive on which it is located and to determine a power configuration of the locomotive based on the distributed energy profile and known parameters of the locomotive.

DETAILED DESCRIPTION

Figure 1:
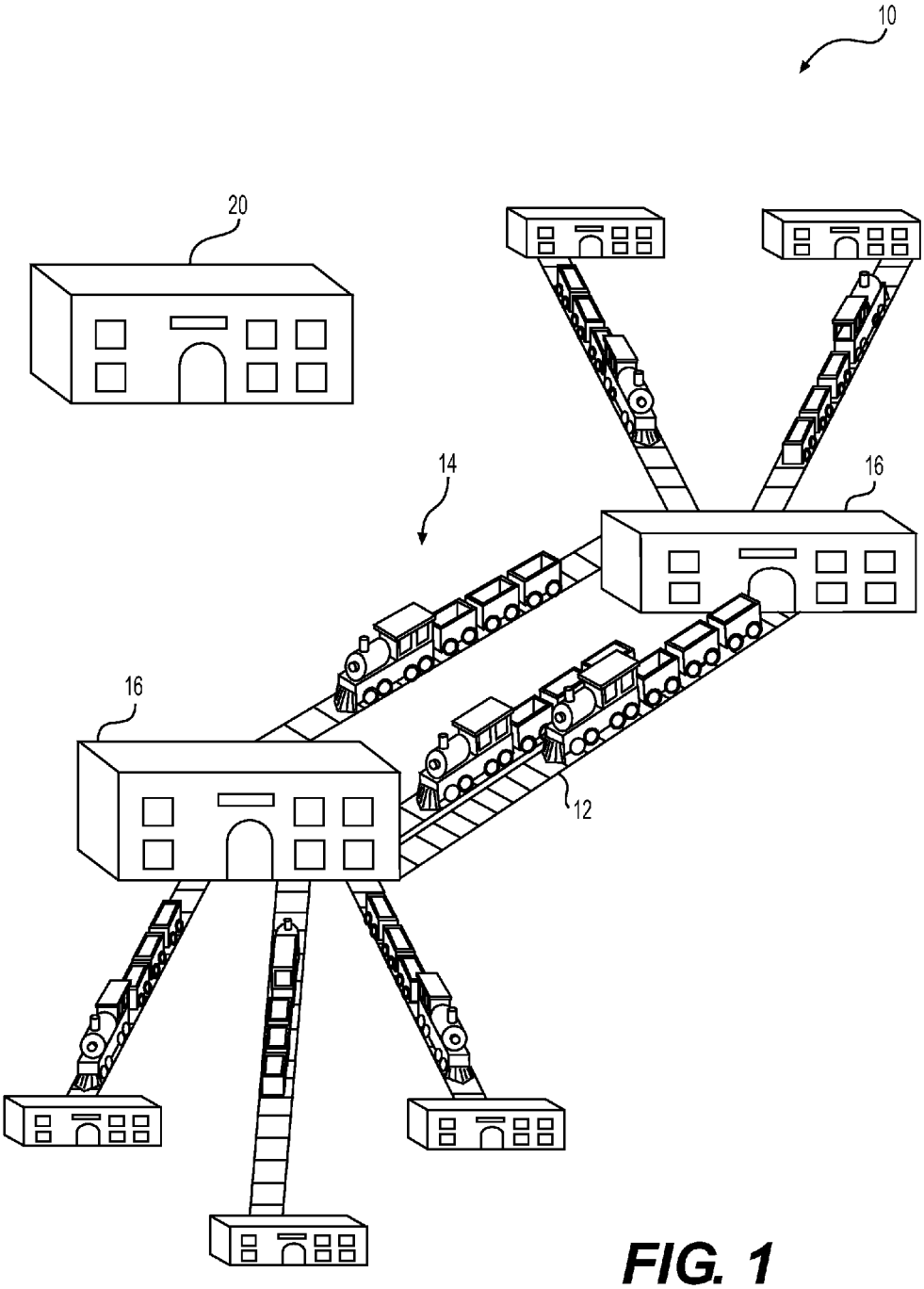
FIG. 1 is an exemplary layout of a railroad network.

FIG. 1 schematically illustrates an exemplary railroad network 10 consistent with certain disclosed embodiments. Railroad network 10 may include any number of tracks 12 that support various trains 14. Tracks 12 may be any type of transportation pathway, such as railroad tracks, subway rails, trolley tracks, etc., on which trains 14 may travel. Tracks 12 may be interconnected or separated, such that some trains 14 travel only on some tracks 12 and other trains 14 travel only on other tracks 12. Each train 14 may include one or more consists that includes any number of locomotives, as well as a plurality of other non-locomotive cars. Railroad network 10 may include manually operated and/or autonomous consists.

A centralized control station 20 may be located near or away from tracks 12 and used by operators and/or electronic controllers to oversee movement of trains 14 throughout railroad network 10. Centralized control station 20 may have components located onboard and offboard trains 14. For example, centralized control station 20 may be an autonomous train control or positive train control. Centralized control station 20 may direct wayside equipment 16 to facilitate passage of trains 14 through railroad network 10. Wayside equipment 16 may include various control devices, such as axle hot box detectors, wheel load detectors, track switches, speed restriction signs, signal lights, gates, or other signal devices configured to manage rail vehicle traffic in railroad network 10.

Figure 2:
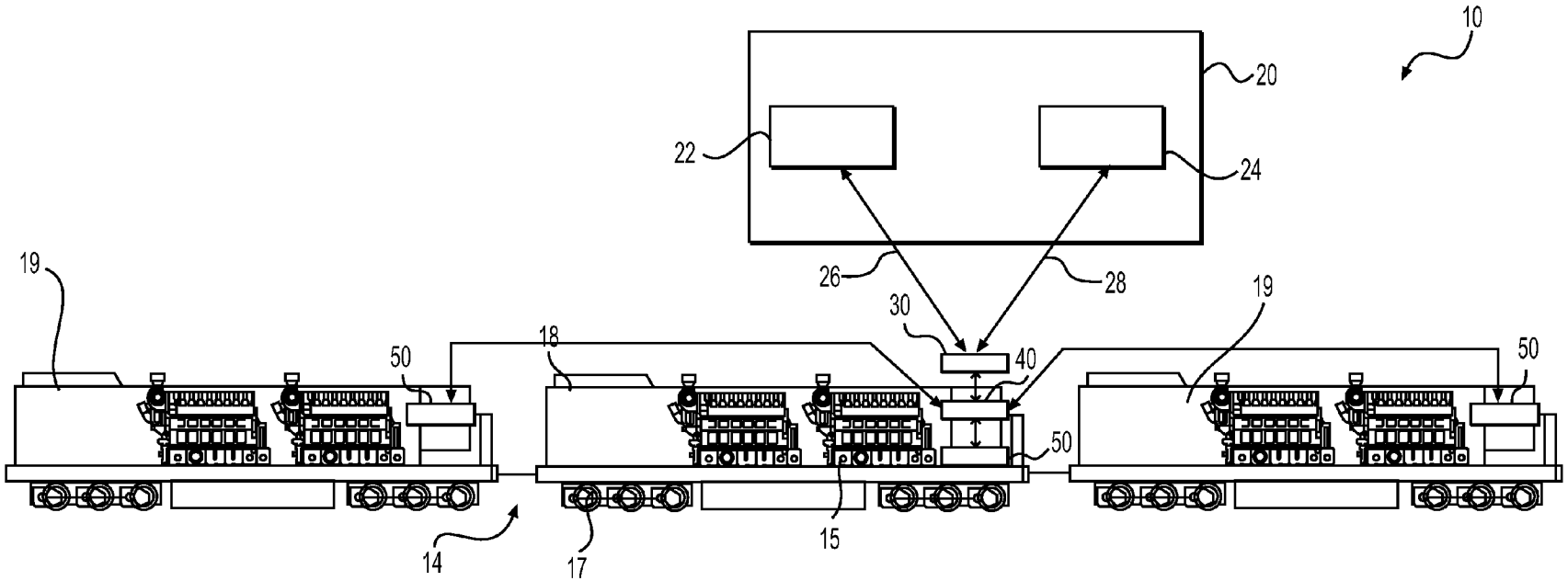
FIG. 2 is a diagrammatic illustration of a system for controlling one or more locomotives in the railroad network of FIG. 1.

FIG. 2 illustrates a control diagram associated with railroad network 10. As shown in this diagram, railroad network 10 may include centralized control station 20, an energy manager 30, and at least one consist manager 40. Centralized control station 20 may be located offboard train 14, while energy manager 30 and consist manager 40 may be located onboard a master locomotive 18 within a particular consist. Railroad network may further include locomotive managers 50, each located onboard master locomotive 18 and slave locomotives 19 within the consist.

Each locomotive 18, 19 is propelled by one or more engines 15 and any number of traction motors 17. Master locomotive 18 may be in any position (leading, middle, or trailing) relative to slave locomotives 19 of consist. An exemplary consist is shown in FIG. 2, as having one master locomotive 18 and two slave locomotives 19, but the consist may have any number of master locomotives 18 and slave locomotives 19.

An operator interface 22 and a central controller 24 may be located at centralized control station 20. Operator interface 22 may communicate with energy manager 30 via a first network 26, and central controller 24 may communicate with energy manager 30 via a second network 28.

Operator interface 22 may be a web-based system that allows a user to provide numerous different inputs regarding the operation of railroad network 10. Operator interface 22 may allow the user to direct individual manual and autonomous trains 14 of railroad network 10, by transmitting unique commands (e.g. turn engine 15 on/off, dump water, and increase/decrease track speed) to individual locomotives 18, 19. In some embodiments, the user may also direct the individual trains by inputting train-specific performance goals into operator interface 22 that require automatic adjustment of multiple systems of the train. These train-specific performance goals may be directed to fuel-efficiency, air and noise pollution, intra-train forces, and urgency. When directing manually operated trains 14, operator interface 22 may have the capability of either notifying the operator of the train of the desired operation, or of overriding manual control. Operator interface 22 may receive a wide variety of parameters from train 14 concerning system and environmental conditions of locomotives 18, 19. Operator interface 22 may receive parameters monitored by energy manager 30, consist manager 40, and/or locomotive managers 50. Moreover, parameters can also be monitored directly from various locomotive sensors, control circuits and devices, track geometry monitors, smoke and fire detectors, chemical or fuel detectors, engine-on relays and emergency brake relays or other data collection devices, locomotive horn and bell indications, hot wheel or hot bearing sensors, and impact sensors. Operator interface 22 may display these parameters to the user of the interface. Operator interface 22 may also transmit the parameters and the train-specific performance goals to central controller 24 and/or energy manager 30 of trains 14.

Central controller 24 may plan a trip for each train 14 based on user-defined goals and other input received from operator interface 22, environmental conditions (e.g. geography, track conditions, weather, and local ordinances of noise, speed and emission, etc.), and train 14 specifications (departure location and time, desired arrival location and time, cargo, load capacity, etc.). Central controller 24 may determine trip parameters including routing, timing, and limitations (e.g. speed and noise emissions) to ensure each train 14 reaches its destination as desired. Central controller 24 may send these trip parameters to operator interface 22 and/or energy manager 30 of each train 14.

First network 26 and second network 28 may include hardware and/or software that enable sending and receiving of data messages. The data messages may be sent and received via a direct data link and/or a wireless communication link, as desired. The direct data link may include an Ethernet connection, a connected area network (CAN), or another data link known in the art. The wireless communications may include satellite, cellular, infrared, and any other type of wireless communications that enable networks 26, 28 to exchange information.

Energy manager 30 may be located onboard master locomotive 18 and configured to receive the trip parameters (e.g. arrival time, track assignment, speed, noise emissions, fuel consumption, etc.) and environmental conditions (e.g. geography, track conditions, weather, and local ordinances of noise, speed and emission, etc.) from central controller 24. Energy manager may also receive the unique commands and the train-specific goals from operator interface 22. Energy manager 30 may further receive current parameters of train 14, including number of locomotives 18, 19 in a particular consist and current consist parameters (e.g. load capacity, load, functionality, etc.). Based on these inputs, energy manager 30 may then determine a power profile (e.g. a power-output level, noise level, fuel consumption rate, etc.) prior to trip departure. The power profile may be determined for each consist, according to known locomotive parameters, and for each segment of the trip in order to achieve the desired trip parameters at every instance. Energy manager 30 may then send the power profile to consist manager 40 of train 14. Energy manager 30 may also continually receive real-time data from consist manager 40 and/or locomotive managers 50 indicating actual parameters of train 14. Energy manager 30 may then selectively modify the power profile depending on any differences between the actual parameters and the power profile, and send the modified power profile back to consist manager 40.

Consist manager 40 may be located on master locomotive 18 and configured to receive the power profile from energy manager 30, and known parameters of individual locomotives 18, 19 (e.g. weights, load capacity, conditions, capability, length, age, etc.) from locomotive manager 50. Consist manager 40 may further continually monitor current parameters of each locomotive 18, 19. Consist manager 40 may distribute the power profile symmetrically or asymmetrically between available locomotives 18, 19 of the consist. After completing a first portion of the trip, the power profile and/or distribution may change for the following segment of the trip. Consist manager 40 may distribute the power profile to any number of locomotives 18, 19 of the consist.

Each locomotive manager 50 may receive the power distribution from consist manager 40. Based on the power distribution and known parameters associated with locomotives 18, 19 (e.g. number and load capacity of engines 15, number and load capacity of traction motors 17, etc.), locomotive manager 50 may determine a power configuration for each locomotive 18, 19. In some embodiments, locomotive manager 50 may receive the power distribution for only the locomotive on which it is located. The power configuration may be determined by subdividing the power distribution between available engines 15 and traction motors 17. The power configuration may include load sharing between engines 15 and/or traction motors 17 on locomotive 18, 19. The subdivision may be symmetric or asymmetric. For instance, the subdivision may direct more power to the engines 15 and traction motors 17 that are functioning more efficiently. The subdivision may effectively deviate or turn off malfunctioning engines 15 and traction motors 17. Locomotive manager 50 may continually monitor operations of engines 15 and traction motors 17 (temperatures, speeds, pressures, etc.), and continually adjust the subdivision of power distribution depending on the current parameters.

All monitored parameters may be reported back to operator interface 22 via first network 26 and to central controller 24 via second network 28. Energy manager 30, consist manager 40, and locomotive manager 50 may also allow remote override of any of the functions, by operator interface 22 and/or central controller 24.

Managers 30, 40, 50 can embody a single microprocessor or multiple microprocessors that include a means for monitoring and distributing. For example, managers 30, 40, 50 may include a memory, a secondary storage device, a clock, and a processor, such as a central processing unit or any other means for accomplishing a task consistent with the present disclosure. Numerous commercially available microprocessors can be configured to perform the functions of managers 30, 40, 50. It should be appreciated that managers 30, 40, 50 could readily embody a general machine controller capable of collectively controlling numerous other engine 15 functions. Various known circuits may be associated with managers 30, 40, 50, including signal-conditioning circuitry, communication circuitry, and other appropriate circuitry.

INDUSTRIAL APPLICABILITY

The disclosed control system and method may be applicable to any transportation network, including subways, trolleys, and railroads. The disclosed control system may increase efficiency in distributing tasks to a network of trains having any number of locomotives.

For example, central controller 24 may direct a train from Kansas City to Des Moines using a particular section of track, leaving at 9 am. Central controller 24 may further direct the train to reduce speed from mile 90 to mile 100 because the train will be going through a small town, and there is a noise regulation at mile 96 because they will be passing a church. Central controller 24 may also receive a train-specific goal of urgency from operator interface 22, since the market for the cargo is currently at an increased price. Central controller 24 may factor the train-specific goal into the trip parameters, requesting the train to increase speed when permitted. Central controller 24 then may send these trip parameters to operator interface 22 and/or energy manager 30 of each train 14.

Energy manager 30 of a train 14 of railroad network 10 may create a power profile according to the trip parameters and the quantity and load capacity of the consists. The power profile may be created prior to the trip, then continuously updated throughout the trip. Energy manage 30 may distribute the power profile to consist managers 40 of the individual consists. Consist manager 40 may receive a power profile of 12,000 horsepower to pull the train 600 feet up a 12% grade at 20 mph with associated noise less than 75 decibels and emissions less than 50% of peak emissions. Consist manager 40 may distribute the power profile to three locomotives 18, 19 with varying load capacity. For example, a first locomotive (such as leading or trailing locomotive) may receive a request of 6,000 horsepower, a second locomotive may receive a request of 4,000 horsepower, and a third locomotive may receive a request of 2,000 horsepower for the particular 600 feet stretch of track. Locomotive manager 50 of each locomotive 18, 19 may receive the distributed power profile, then initiate load sharing between available engines 15 and/or traction motors 17.

It will be apparent to those skilled in the art that various modifications and variations can be made to the disclosed railroad control system. Other implementation will be apparent to those skilled in the art from consideration of the specification and practice of the disclosed methods. It is intended that the specification and examples be considered as exemplary only, with a true scope being indicated by the following claims and their equivalents.

What is claimed is:

1. A railroad control system for a network of trains, comprising:

a centralized control system configured to transmit trip parameters for each train in the network;

an energy manager in communication with the centralized control system and located onboard each train, wherein the energy manager is configured to determine an energy profile for a consist of the train based on the trip parameters;

a consist manager located onboard the consist and configured to determine a distribution of the energy profile for each locomotive of the consist; and one or more locomotive managers, each associated with a locomotive of the consist, and configured to determine a power configuration of the locomotive based on the distribution of the energy profile and known parameters of the locomotive, wherein the centralized control system includes an operator interface and a central controller, wherein the operator interface is configured to communicate with the energy manager via a first network, and the central controller is configured to communicate with the energy manager via a second network, and wherein the operator interface is configured to send unique commands to individual locomotives of the consist.

2. The railroad control system of claim 1, wherein the trip parameters include one of an arrival time, a track assignment, and a speed.

3. The railroad control system of claim 1, wherein the energy manager is configured to determine the energy profile prior to a trip departure.

4. The railroad control system of claim 1, wherein the energy manager is configured to receive a signal indicating actual parameters of the train, make a comparison of the actual parameters and the energy profile, and selectively update the energy profile during the trip based on the comparison.

5. The railroad control system of claim 1, wherein the distribution of the energy profile is asymmetric among the locomotives.

6. The railroad control system of claim 1, wherein the power configuration includes load sharing between a plurality of engines or traction motors on the locomotive.

7. The railroad control system of claim 1, wherein each locomotive manager only receives the distribution of the energy profile for the locomotive on which it is located.

8. The railroad control system of claim 1, wherein the operator interface is configured to display parameters monitored onboard each locomotive.

9. The railroad control system of claim 1, wherein the central controller is configured to transmit the trip parameters to the energy manager.

10. The railroad control system of claim 1, wherein the operator interface is configured to send train-specific performance goals to the energy manager.

11. A method of controlling a railroad network including a plurality of trains, comprising:

transmitting trip parameters associated with a desired trip from a centralized control system to each train, wherein the centralized control system includes an operator interface and a central controller;

determining an energy profile using an energy manager for at least one consist of each train based on the trip parameters;

distributing the energy profile to each locomotive of the at least one consist;

determining a power configuration of engines and traction motors onboard each locomotive based on the distribution of the energy profile;

communicating with the energy manager using the operator interface via a first network;

communicating with the energy manager using the central controller via a second network; and sending unique commands to individual locomotives of the consist using the operator interface.

12. The method of claim 11, wherein the power configuration includes load sharing between a plurality of engines or traction motors on each locomotive.

13. The method of claim 11, wherein the determining the energy profile is performed prior to the train departing on a trip.

14. The method of claim 13, further comprising displaying parameters monitored onboard each locomotive.

15. The method of claim 13, further comprising receiving a signal indicating actual parameters of the train, making a comparison of the actual train parameters to the energy profile, and selectively updating the energy profile during the trip based on the comparison.

16. The method of claim 13, wherein the distributing the energy profile includes distributing the energy profile asymmetrically among each locomotive.

17. The method of claim 13, further comprising receiving train-specific goals, and the determining the energy profile is based on the train-specific goals.

18. A railroad network comprising:

a network of trains, each train including at least one consist having one or more locomotives;

a centralized control system including:

an operator interface configured to receive train-specific goals;

a central controller configured to transmit trip parameters for each train;

an energy manager located onboard each consist and configured to determine and update an energy profile for the consist based on the trip parameters, train-specific goals, and current train parameters, wherein the operator interface is configured to communicate with the energy manager via a first network, and the central controller is configured to communicate with the energy manager via a second network;

a consist manager located onboard each consist and configured to determine a distribution of the energy profile for each locomotive of the consist, and distribute the energy profile among each locomotive of the consist; and a plurality of locomotive managers, each locomotive manager associated with a locomotive of the consist, and configured to receive the distributed energy profile for only the locomotive on which it is located and to determine a power configuration of the locomotive based on the distributed energy profile and known parameters of the locomotive, and wherein the operator interface is configured to send unique commands to individual locomotives of the consist.

* * * * *